US005215511A

United States Patent [19]

Cheng

[11] Patent Number: 5,215,511

[45] Date of Patent: Jun. 1, 1993

[54] INDOOR GYMNASTIC APPARATUS WITH MEANS FOR BACK MASSAGING

[76] Inventor: Wen-Liang Cheng, No. 22-35, Chi Tzu Tou, Kuan Shih Tsun Shui Chang Hsien Chia I, Taiwan

[21] Appl. No.: 883,265

[22] Filed: May 14, 1992

[51] Int. Cl.[5] ..... A63B 21/02

[52] U.S. Cl. ..... 482/121; 482/133; 482/142

[58] Field of Search ..... 482/121-123, 482/131-133, 100, 135, 138, 148, 137, 52, 72, 92, 93, 97, 140-142, 907; 128/57, 58

[56] References Cited

U.S. PATENT DOCUMENTS

| | | | |
|---|---|---|---|
| 4,500,089 | 2/1985 | Jones | 482/100 |
| 4,583,731 | 4/1986 | Crivello et al. | 482/138 |
| 4,627,614 | 12/1986 | Rockwell et al. | 482/137 |
| 4,819,936 | 4/1989 | Muller | 482/131 |
| 4,902,008 | 2/1990 | Jones | 482/137 |

FOREIGN PATENT DOCUMENTS 6121902 10/1984 Fed. Rep. of Germany ..... 482/121

*Primary Examiner*—Richard J. Apley
*Assistant Examiner*—Jerome Donnelly
*Attorney, Agent, or Firm*—Bacon & Thomas

[57] ABSTRACT

An indoor gymnastic apparatus comprising an oscillating rod fastened to a base frame behind a seat to hold a rear extension rod, two handlebars connected to said seat at two opposite sides, a rocker seat made on said rear extension rod at one side to hold rotary cylindrical cushions, said rotary cylindrical cushions being each covered with a covering having raised portions over the outside surface thereof, a flat back cushion made on said rear extension rod at an opposite side, a front extension rod connected to said base frame to hold a pair of pedals for pedaling by the legs, wherein said rear extension rod follows the user's back to alternatively oscillate back and forth permitting said cylindrical cushions to massage the user's back.

5 Claims, 4 Drawing Sheets

INDOOR GYMNASTIC APPARATUS WITH MEANS FOR BACK MASSAGING

BACKGROUND OF THE INVENTION

1. Field of the Invention

The present invention relates to indoor gymnastic apparatus, and more particularly the present invention relates to an indoor gymnastic apparatus which has rotary cylindrical cushions supported on a rocker seat to massage the user's back when a rear extension rod and an oscillate rod, onto which the rocker seat is mounted, follows the user's back to alternatively oscillate back and forth.

2. Description of Prior Art

Sitting in a chair for a long length of time may cause one to have a sore waist and aching back, and poor sitting posture may cause one's spine to deform. These are the common problems to those who work in offices. Proper exercise and massage can help people to relax the muscles and joints and relieve from fatigue. The present invention has been accomplished to provide an indoor gymnastic apparatus which can be used to exercise the muscles and massage the back.

SUMMARY OF THE INVENTION

According to one aspect of the present invention, an indoor gymnastic apparatus is generally comprised of an oscillating rod fastened to a base frame behind a seat to hold a rear extension rod, two handlebars connected to the seat at two opposite sides, a rocker seat made on the rear extension rod at one side to hold a plurality of rotary cylindrical cushions, which are each covered with a covering having raised portions over the outside surface thereof, a flat back cushion made on the rear extension rod at an opposite side, a front extension rod connected to the base frame to hold a pair of pedals for pedaling by the legs. The rear extension rod follows the user's back to alternatively oscillate back and forth permitting the cylindrical cushions to massage the user's back.

According to another aspect of the present invention, the position of the rear extension rod in the oscillating rod is changed through 180° angle permitting the flat back cushion to firmly support the user's back when the oscillating rod has been fixedly locked in position by a lock pin.

According to still another aspect of the present invention, one pair of pedals are bilaterally connected to the front extension rod for pedaling by the legs alternatively.

According to still another aspect of the present invention, the oscillating rod has a bottom end pivoted to the base frame and a cross bar at an upper level connected to a cross bar on the seat by elastic connections, which automatically pull the oscillating rod back to its original position after each backward stroke.

According to still another aspect of the present invention, by increasing the number of the elastic connections, the amount of exercise is increased.

According to still another aspect of the present invention, hydraulic cylinders may be used in place of the elastic connections.

BRIEF DESCRIPTION OF THE DRAWINGS

The foregoing and other objects, features and advantages of the present invention will be best understood from the following description, the appended claims and accompanying drawings in which:

FIG. 2-A is a plain view showing the back stroke of the rear extension rod;

FIG. 2-B is a plain view showing the return stroke of the rear extension rod;

DETAILED DESCRIPTION OF THE PREFERRED EMBODIMENTS

Figure 1:
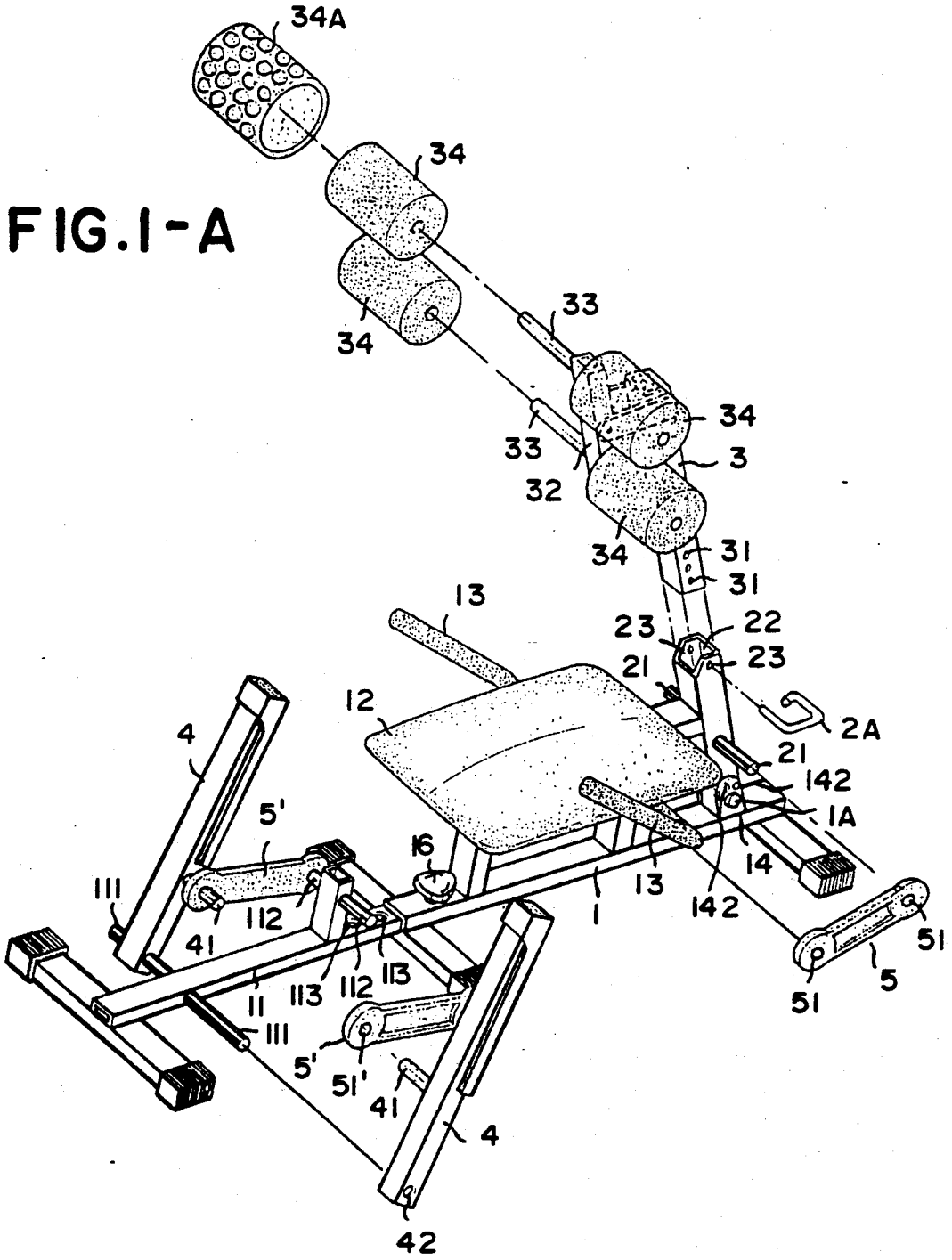
FIGS. 1 and 1-A are elevational and partly exploded views of an indoor gymnastic apparatus as constructed in accordance with the present invention.

Referring to FIG. 1, a front extension rod 11 longitudinally slides inside a base frame 1. The base frame 1 comprises a seat 12 at the top, two handlebars 13 bilaterally connected to the seat 12 for the holding of the hand, a pivot support 14 near the rear end thereof at the top, a cross bar 15 below the seat 12, and a lock screw 16 near the front end thereof. The pivot support 14 has two pivot holes 141, 142 near to top edge thereof, into which a locating pin 1B may be alternatively inserted. The front extension rod 11 comprises a first cross bar 111 near the front end thereof, a second cross bar 112 rising behind the first cross bar 11, and a line of locating holes 113 longitudinally aligned near the rear end thereof. By threading the lock screw 16 into either locating hole 113, the front extension rod 11 is secured to the base frame 1 at the desired length. There is provided an oscillating rod 2 connected to the pivot support 14 by a pivot bolt 1A. The oscillating rod 2 has a through hole 24 near the bottom end thereof, which is to be aligned with either pivot hole 141 or 142, a cross bar 21 at the middle, a center hole 22 through the longitudinal axis thereof for inserting a rear extension rod 3, through hole 23 through the body near the top edge thereof for inserting a lock bolt 2A in locking the rear extension rod 3. The rear extension rod 3 has a line of through holes 31 near the bottom end thereof. By inserting the lock bolt 2A through the through hole 23 on the oscillating rod 2 into either through hole 31 on the rear extension rod 3, the rear extension rod 3 is connected to the oscillating rod 2 at the desired length. There is a rocker seat 32 pivoted to the rear extension rod 3 near the top end thereof. The rocker seat 32 has cylindrical cushions 34 connected thereto by bolts 33. The cylindrical cushions 34 are permitted to be freely rotated on the bolts 33 (See FIG. 2). The rear extension rod 3 further comprises a flat back cushion 35 longitudinally attached to the back side thereof (opposed to the cylindrical cushions 34). There is provided a pair of pedals 4 bilaterally coupled to front extension rod 11. The pedals 4 have each a side connecting rod 41 at the middle connected to the second cross bar 112 at either end by an elastic connection 5' and a through hole 42 near the front end thereof, through which the first cross bar 111 is inserted. The elastic connection 5' has two connecting rings 51 at the two opposite ends thereof, through which the first and second cross bars 111, 112 are respectively inserted. There is also provided another pair of elastic connections 5 in connecting the cross bar 21 of the oscillating rod 2 to the cross bar 15 of the base frame 1. The elastic connections 5 also have each two connecting rings 51 at two opposite ends for inserting the cross bars 21, 15 respectively. Cushion rings or washers may be attached to the connecting rings 51 for protection against friction.

Figure 2:
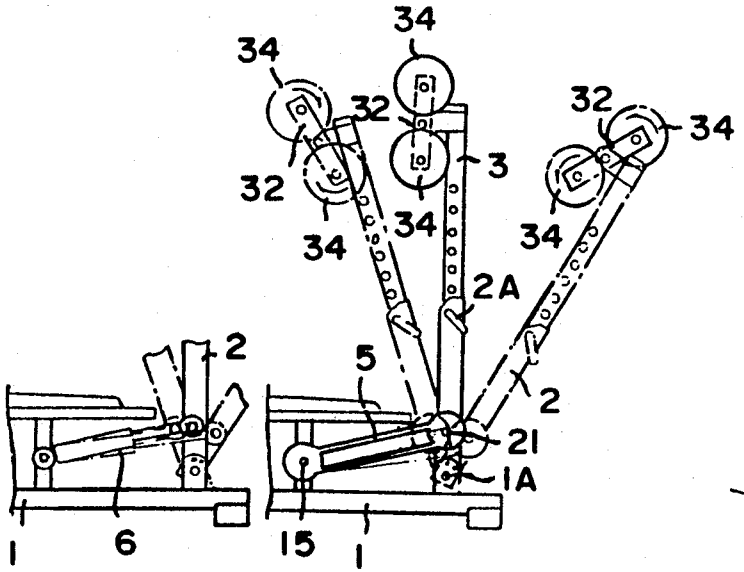
FIG. 2 is a schematic drawing showing that the rear extension rod and the cylindrical cushions thereon can be carried to oscillate alternatively back and forth by the oscillating rod.
Figure 3:
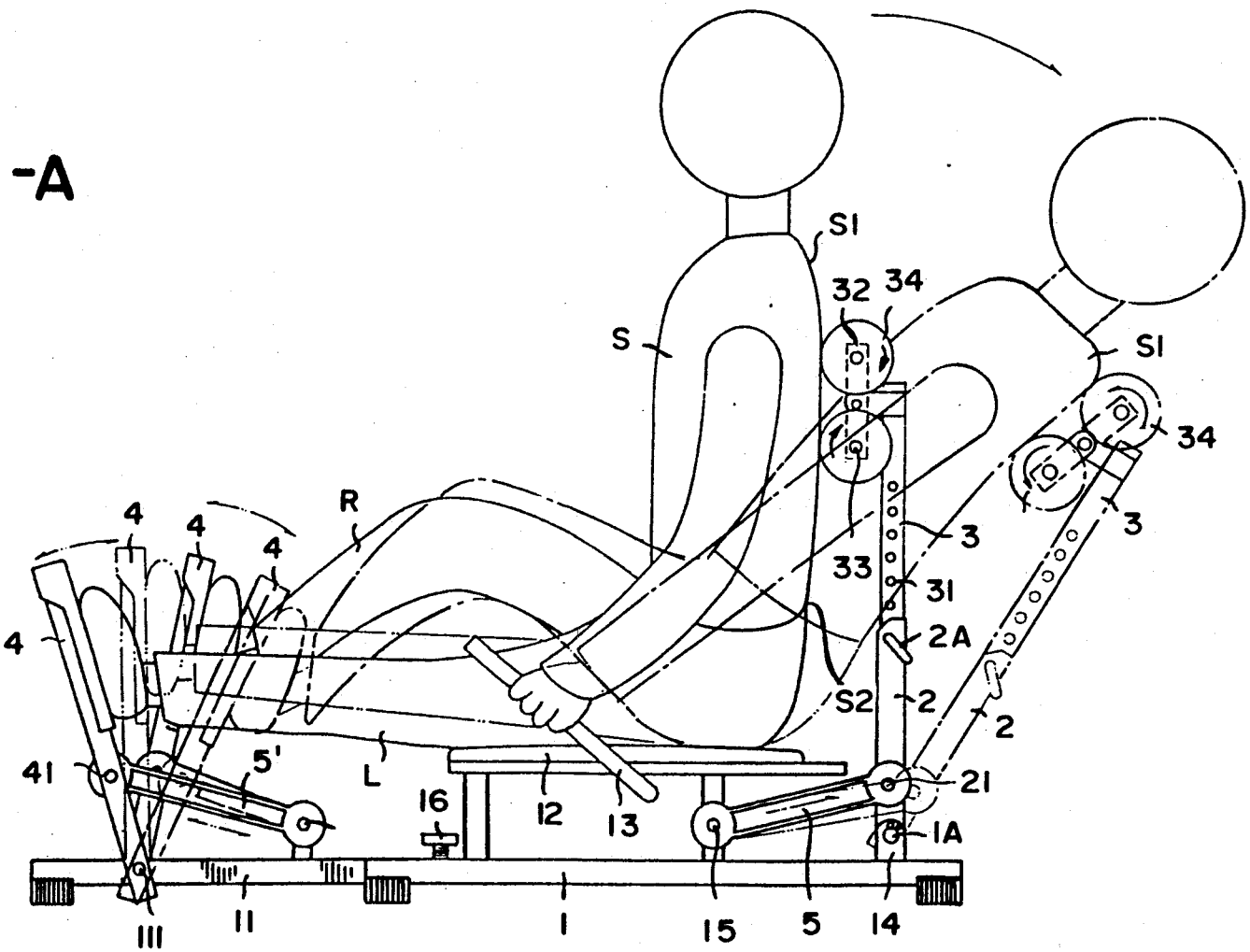

When assembled, the rear extension rod 3 is secured to the oscillating rod 2 by the lock bolt 2A to hold the rocker seat 32 and the cylindrical cushions 34, and the pedals 4 are pivotably connected to the first cross bar 111, as shown in FIG. 2A (the locating pin 1B is not inserted in either pivot hole 141 or 142), and therefor the user S can sit on the seat 12 with the legs L,R alternatively pedaling the pedals 4. While pedaling, the user's hands are held on to the handlebars 13, and the user's back is supported on the cylindrical cushions 34. Therefore, lying the upper part of the user's back on the cylindrical cushions 34 causes the rear extension rod 3 and the oscillating rod 2 to oscillate backwards, releasing the pressure from the cylindrical cushions 34 causes the rear extension rod 3 and the oscillating rod 2 to be pulled back to their original position by the elastic connections 5. Repeating the aforesaid procedure causes the rear extension rod 3 and the oscillating rod 2 to alternatively rotate back and forth. During the reciprocating movement of the rear extension rod 3 and the oscillating rod 2, the cylindrical cushions 34 are caused to roll on the user's loin between the shoulder blade S1 and the small of the back S2 (see FIGS. 2-A and 2-B) in massaging the muscles and joints. In order to produce better massaging effects, a covering 34A which has raised portions over the outside surface thereof may be covered on each cylindrical cushion 34. While pedaling, the user can also exercise the muscles around the waist by bending the truck forward over the bearing point near the lower part Ss of the waist (see FIG. 2-B). When the rear extension rod 3 and the oscillating rods 2, or the pedals 4 were released from pressure, the elastic connections 5 or 5' automatically pull the rear extension rod 3 and oscillating rods 2, or the pedals 4 back to their original positions. By increasing the number of the elastic connections 5,5' the amount of exercise is relatively increased.

Figure 4:
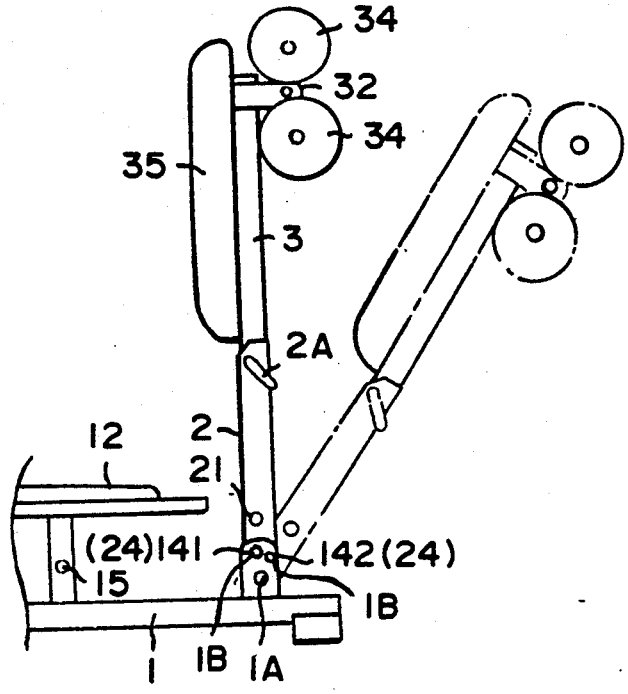
FIG. 4 illustrates that the rear extension rod has been changed through 180° angle permitting the flat back cushion to be turned to the front in supporting the user's back.

Referring to FIG. 4, by changing the position of the rear extension rod 3 on the oscillating rod 2 through 180° angle, the flat back cushion 35 is turned to the front side in supporting the user's back. Under this mode, the locating pin 1B is inserted through either pivot hole 141 or 142 on the pivot support 14 into the through hole 24 on the oscillating rod 2, permitting the oscillating rod 2 to be firmly retained to the pivot support 14.

Figure 3:
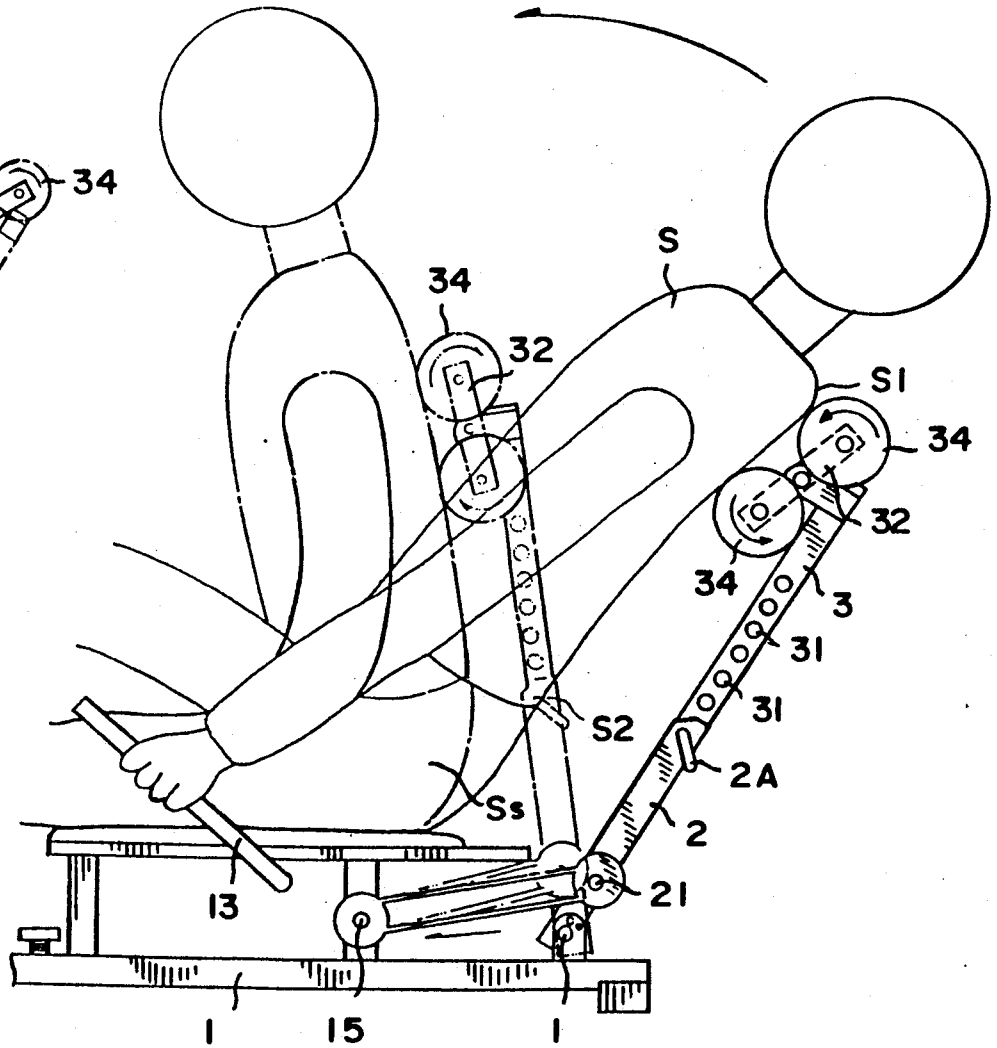
FIG. 3 illustrates that a hydraulic cylinder is used to connect the oscillating rod to the base frame.
Figure 5:
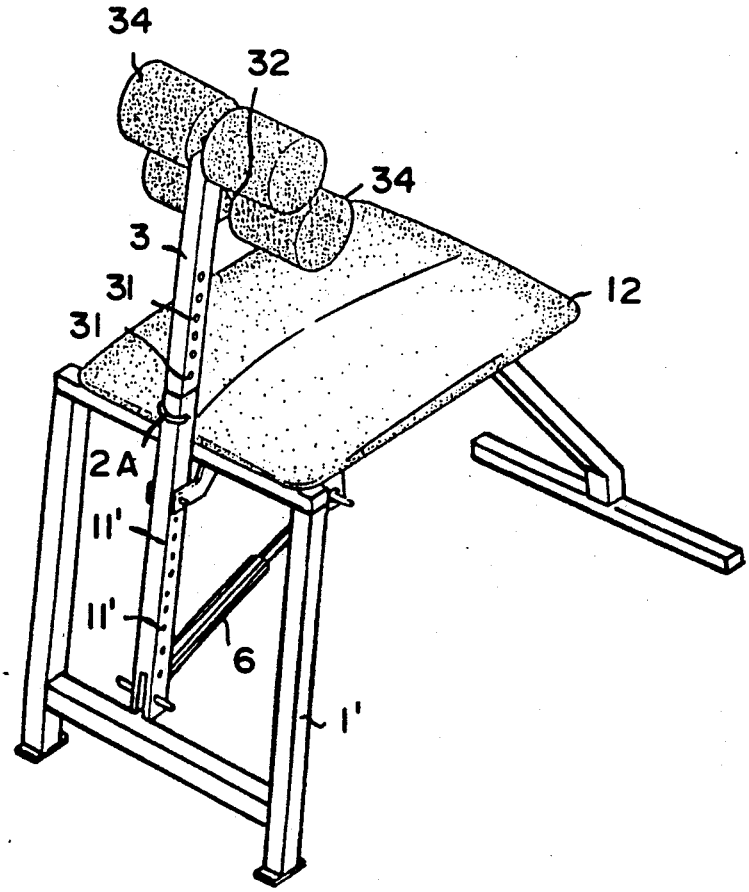
FIG. 5 is an elevational view of an alternate form of the present invention.

In an alternate form of the present invention, hydraulic cylinders 6 may be used in place of the elastic connections 5,5' (see FIGS. 3 and 5). In the embodiment of FIG. 5, a hydraulic cylinder 6 is connected to either locating hole 11' on the oscillating rod below the base frame 1' thereof.

What is claimed is:

1. An indoor gymnastic apparatus comprising:

a base frame, said base frame comprising a seat at the top, two handlebars bilaterally connected to said seat, a pivot support near a rear end thereof at the top, a first cross bar below said seat transversely bilaterally extended outwards, and a lock screw near a front end thereof at the top;

a front extension rod longitudinally connected to said base frame at one end, said front extension rod having a line of holes aligned near a rear end thereof for inserting said lock screw alternatively;

an oscillating rod pivotably connected to said pivot support at the top, said oscillating rod having a second cross bar transversely bilaterally extended outwards, a center hole through the longitudinal axis thereof, and a through hole near a top end thereof;

a rear extension rod inserted into the center hole on said oscillating rod, said rear extension rod having a line of through holes near a bottom end thereof alternatively connected to the through hole on said oscillating rod by a lock bolt;

a rocker seat pivoted to said rear extension rod at one side, said rocker seat having a plurality of cylindrical cushions revolvably transversely connected thereto by bolts;

elastic connections respectively connected between said first and second cross bars at two opposite sides, said elastic connections having each two opposite eyed ends respectively attached with cushion rings and connected to either cross bar at either end; and wherein lying the upper part of the user's back on said cylindrical cushions causes said rear extension rod and said oscillating rod to oscillate backwards; releasing the pressure from said cylindrical cushions causes said rear extension rod and said oscillating rod to be pulled back to their original position by said elastic connections.

2. The indoor gymnastic apparatus according to claim 1, wherein said cylindrical cushions are each covered with a covering having raised portions over the outside surface thereof for massaging the user's back.

3. The indoor gymnastic apparatus according to claim 1, wherein said rear extension rod comprises a flat back cushion at an opposite side which firmly supports the user's back when said oscillating rod has been fixedly locked in position by a lock pin.

4. The indoor gymnastic apparatus according to claim 1, wherein said extension rod has one pair of pedals bilaterally connected thereto for pedaling by the legs alternatively.

5. The indoor gymnastic apparatus according to claim 1, wherein reciprocating means may be used to connect said first and second cross bars together.

* * * * *